US008113973B1

(12) United States Patent
Lee

(10) Patent No.: US 8,113,973 B1
(45) Date of Patent: Feb. 14, 2012

(54) HUNTING ARROWHEAD WITH ROTARY BLADE

(76) Inventor: Young Ki Lee, Busan (KR)

( * ) Notice: Subject to any disclaimer, the term of this patent is extended or adjusted under 35 U.S.C. 154(b) by 0 days.

(21) Appl. No.: 13/039,958

(22) Filed: Mar. 3, 2011

(30) Foreign Application Priority Data

Dec. 8, 2010 (KR) ..... 10-2010-0124912

(51) Int. Cl.
*F42B 6/08* (2006.01)

(52) U.S. Cl. ..... 473/583

(58) Field of Classification Search ..... 473/582, 473/583, 584
See application file for complete search history.

(56) References Cited

U.S. PATENT DOCUMENTS 3,618,948 A * 11/1971 McGlocklin ..... 473/583
4,973,060 A 11/1990 Herzig
5,390,936 A 2/1995 Westenberg
6,319,161 B1 11/2001 Martinez et al.
6,863,630 B1 * 3/2005 Watkins et al. ..... 473/583
7,037,222 B2 5/2006 Mizek et al.
8,057,331 B2 * 11/2011 Hudkins ..... 473/583

* cited by examiner

*Primary Examiner* — John Ricci
(74) *Attorney, Agent, or Firm* — Birch, Stewart, Kolasch & Birch, LLP

(57) ABSTRACT

Disclosed is a hunting arrowhead for gaining ascendancy over and hunting the wild animals such as a deer quickly and accurately without degrading the flight stability and the hit rate of an arrow. The hunting arrowhead includes a ferrule having a ferrule body, in which a fitting slot is formed in a longitudinal direction, and a mounting screw section extending rearwards from the ferrule body, a blade assembly, a rear portion of which is fitted into the fitting slot, and in which a leading edge is formed on a side end thereof, and a mounting slot for a rotary blade and a rotary pin-receiving hole are formed in a flat surface thereof, and a rotary blade rotatably mounted in the mounting slot and having a central pin-hole and a circumferential cutting blade part.

12 Claims, 5 Drawing Sheets

HUNTING ARROWHEAD WITH ROTARY BLADE

BACKGROUND OF THE INVENTION

1. Field of the Invention

The present invention relates, in general, to a hunting arrowhead and, more particularly, to a hunting arrowhead with a rotary blade for gaining ascendancy over and hunting wild animals such as a deer quickly and accurately without degrading the flight stability and the hit rate of an arrow.

2. Description of the Related Art

Generally, an arrow is composed of a hollow arrow shaft, an arrowhead added to a leading end of the arrow shaft, the notch of an arrow to which the arrow fits on the string, and feathering for securing the flight stability of an arrow.

The arrowhead serves to practically pass through an object, so it should have excellent wear resistance and strength and it should have a structure enabling itself to fly stably, because upon hitting the object, the accumulated energy of an arrow is collected upon the arrowhead.

Generally, an arrowhead has a sharpened tip to improve its penetration, but such a sharpened arrowhead is not practical for certain types of hunting. This is because it is difficult for the sharpened arrowhead to kill large game and thus gain control over the same. Thus, taking this into account, a broad type arrowhead which has two to four sharp blades on its edge to induce profuse bleeding to kill game may be used.

There is also disclosed an arrowhead in which the blades are normally folded inside the arrowhead and upon hitting a target, are then unfolded, since the blades of the broad type arrowhead is able to affect the flight stability of an arrow.

FIGS. 7 to 10 illustrate a variety of conventional examples of a broad type arrowhead, which are disclosed in U.S. Pat. No. 7,037,222 B2 entitled "BROADHEAD ARROWHEAD," U.S. Pat. No. 6,319,161 B1 entitled "ARROWHEAD AND METHOD OF MAKING," U.S. Pat. No. 5,390,936 entitled "BLADE FOR ARROW BROADHEAD," and U.S. Pat. No. 4,973,060 entitled "ARROWHEAD WITH EXPANDABLE BLADES," respectively.

FIG. 7 shows a structure with a rear portion of a blade assembly where a leading edge is formed on a side edge in a bent shape in order to increase the penetration performance, and FIG. 8 shows a structure in which a spiral cutting edge is formed in a core member at the rear side of a leading penetrating tip.

FIG. 9 shows a structure in which a plurality of teeth is formed on an upper end of a triangular blade, and FIG. 10 shows a structure in which a blade is mounted on a cylindrical sleeve such that it is elastically unfoldable by means of a link arm, in order to excessively tear a penetrated part.

While these arrowheads all are developed for increasing the penetration performance and kill rate with respect to game, among them, in the structures of FIGS. 7 and 8, the blade assembly may hinder the function of feathering, possibly causing a problem in flight stability, and particularly in the structure of FIG. 8, the shape is complicated so that it is difficult to manufacture the structure.

The structure of FIG. 9 has a problem in that if the arrow directly impacts the game's bone, the arrow may bounce off from the bone, and the structure of FIG. 10 does not cause a problem of the flight stability, but has problems in that the blade may not be unfolded in a timely manner, and even when the blade is unfolded correctly, it has a limited capacity to enlarge the wound and pass through the bone, and the manufacturing cost increases.

Thus, there is a need to develop an arrowhead that has excellent penetration performance with respect to the game's bone or internal organs without affecting the flight stability of an arrow and the hit rate on a target, thereby gaining ascendancy over game at a single stroke.

DOCUMENTS OF RELATED ART

U.S. Pat. No. 7,037,222 B2 entitled "BROADHEAD ARROWHEAD";

U.S. Pat. No. 6,319,161 B1 entitled "ARROWHEAD AND METHOD OF MAKING";

U.S. Pat. No. 5,390,936 entitled "BLADE FOR ARROW BROADHEAD"; and

U.S. Pat. No. 4,973,060 entitled "ARROWHEAD WITH EXPANDABLE BLADES."

SUMMARY OF THE INVENTION

Accordingly, the present invention has been made keeping in mind the above problems occurring in the related art, and the present invention proposes an arrowhead that is excellent in terms of penetration performance and kill rate with respect to game without affecting the flight stability and hit rate of an arrow.

A further object of the present invention is to provide an arrowhead that is able to enlarge the hit part of game or effectively pass through the internal organs of game, and even when impacting upon the game's bone, pass through the part near the bone while making a detour around the bone, thereby gaining ascendancy over game in a rapid and accurate manner.

In order to achieve the above objects, according to one aspect of the present invention, there is provided a hunting arrowhead including: a ferrule having a ferrule body, in which a fitting slot is formed in a longitudinal direction, and a mounting screw section extending rearwards from the ferrule body; a blade assembly, a rear portion of which is fitted into the fitting slot, and in which a leading edge is formed on a side end thereof, and a mounting slot for a rotary blade and a rotary pin-receiving hole are formed in a flat surface thereof; and a rotary blade rotatably mounted in the mounting slot and having a pin-hole in a center thereof and a cutting blade part on a circumference thereof.

In an exemplary embodiment, the mounting slots and the rotary blades mounted thereto may be provided in a pair on opposite sides of the ferrule body.

In an exemplary embodiment, the cutting blade part of the rotary blade may be formed with an waved part including convex portions and concave portions that alternately repeat in a circumferential direction.

In an exemplary embodiment, the cutting blade part of the rotary blade may include a plurality of teeth that is continuously formed in a circumferential direction.

In an exemplary embodiment, the rotary blade may include a central flat portion with the pin-hole formed therein, an inclined portion extending in an inclined form towards an outer circumference from the central flat portion, and the cutting blade part formed on a circumference of the inclined portion.

In an exemplary embodiment, the rotary blade may be provided with a plurality of through-holes passing through the flat surface thereof.

According to the present invention, there are effects as follows:

The rotary blade section is mounted on the planar blade so that the penetration performance or lethality with respect to game increase, but the flight stability and hit rate of an arrow is not affected.

Particularly, according to the present invention, the arrowhead can enlarge the hit part of game or effectively pass through the internal organs of game, and even upon impacting the game's bone, it can pass through the part near the bone while making a detour around the bone, thereby gaining ascendancy over game in a rapid and accurate manner.

Further, according to the present invention, the rotary blade is detachably mounted onto a conventional dual-blade assembly, so that the manufacturing process is simplified and the production cost is lower than those of the conventional spiral blade and the elastic blade.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
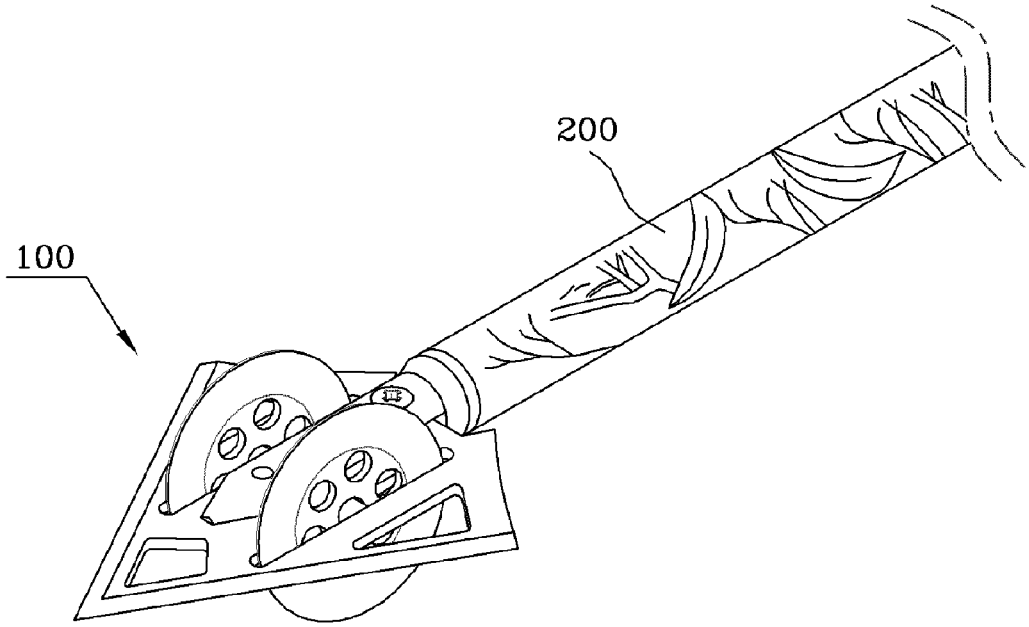
FIG. 1 is a view showing a front portion of an arrow with an arrowhead according to the present invention mounted.

Reference will now be made in greater detail to the construction and its operating principle of the invention, an example of which is illustrated in the accompanying drawings. Wherever possible, the same reference numerals will be used throughout the drawings and the description to refer to the same or like parts.

Figure 2:
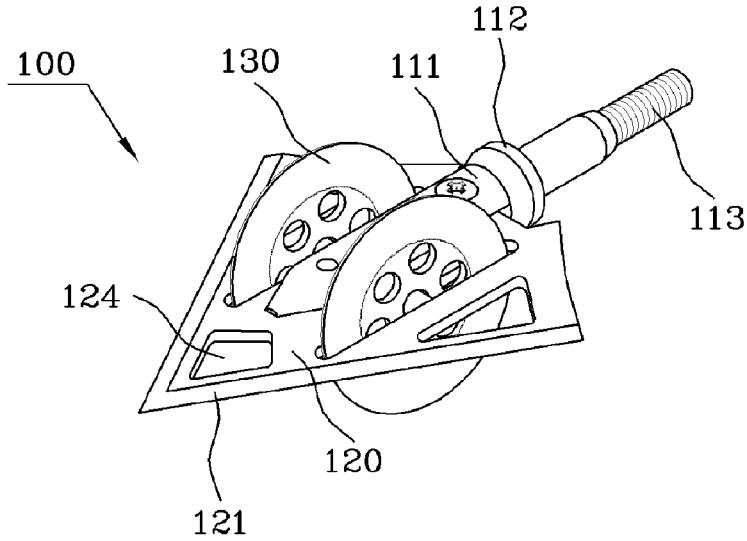
FIG. 2 is a perspective view showing the arrowhead.
Figure 3:
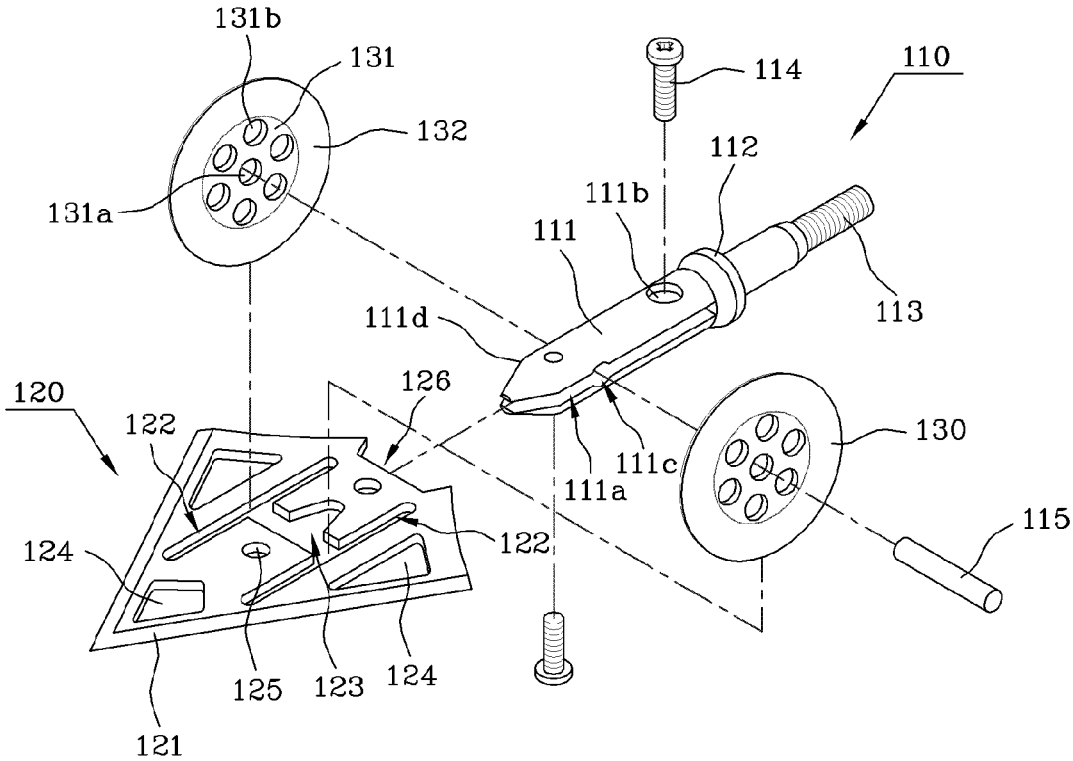
FIG. 3 is an exploded perspective view showing the arrowhead.

FIG. 1 is a view showing a front portion of an arrow with an arrowhead according to the present invention mounted, FIG. 2 is a perspective view showing the arrowhead, and FIG. 3 is an exploded perspective view showing the arrowhead.

The arrowhead 100 is mounted onto a leading end of an arrow shaft 200 by means of screwing or the like, and basically includes a ferrule 110 mounted onto the leading end of the arrow shaft 200, a blade assembly 120 fitted into the ferrule 110, and rotary blades 130 rotatably mounted in the blade assembly 120.

The ferrule 110 includes a ferrule body 111 which is generally cylindrical, a rear section 112 which extends rearwards from the ferrule body 111 and has a diameter larger than that of the ferrule body 111, and a mounting screw section 113 which extends rearwards from the rear section 112 and has a thread on a circumferential surface.

The ferrule body 111 is formed so that a leading end portion is provided with an inclined face 111*d*, and at least one through-hole 111*b* is formed at certain positions on the circumferential face. Inside the ferrule body 111, a longitudinal fitting slot 111*a* is formed to a certain depth. At a certain position of the fitting slot 111*a*, a pin-hole 111*c* is formed as shown in the drawing.

A planar blade assembly 120 having dual blades is fitted at its rear portion into the fitting slot 111*a* of the ferrule body 111. The blade assembly 120 is provided in the rear end side with a fitting recess 126.

The blade assembly 120 is formed so that leading edges 121 are provided on opposite side ends of the leading portion thereof so as to pass through a target, a pair of corresponding mounting slots 122 for the rotary blades are formed in a flat surface of the central portion thereof, and a rotary pin-receiving hole 123 is connected between the mounting slots. Unexplained reference numeral 124 in the drawings denotes an opening vertically passing through the flat surface of the blade assembly 120.

The blade assembly 120 is securely fixed to the ferrule 110 by fitting it into the fitting slots 111*a* of the ferrule 110 and then fixing it using fixing screws 114 and through-holes 111*b* and 125. The through-hole 111*b* of the ferrule body 111, which is coupled with the fixing screw 114, may be preferably provided with an internal screw. Instead of the screw type clamp means, another clamping means such as a rivet or the like may be used to couple the blade assembly and the ferrule to each other.

In the mounting slots 122 for the rotary blades, the respective circular rotary blades 130 are mounted such that they are rotatable about a rotary pin 115.

Figure 4:
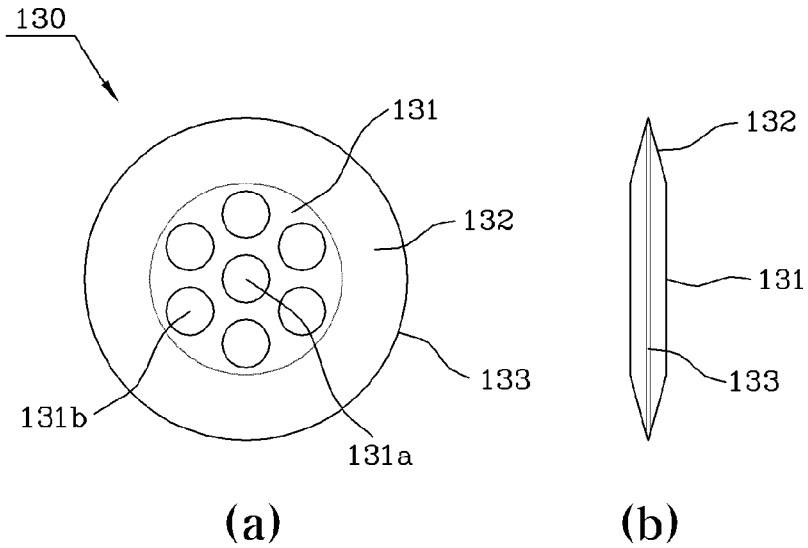
FIGS. 4A and 4B are a front view and a side view showing a rotary blade according to a first embodiment of the present invention.

FIGS. 4A and 4B are a front view and a side view showing a rotary blade according to a first embodiment of the present invention. The rotary blade 130 generally has a circular form in which a central flat portion 131 is formed at the center thereof, and an inclined portion 132, a surface of which is inclined radially, is formed radially from the central flat portion 131. A cutting blade part 133 is formed on a circumferential end of the inclined portion 132.

Figure 5:
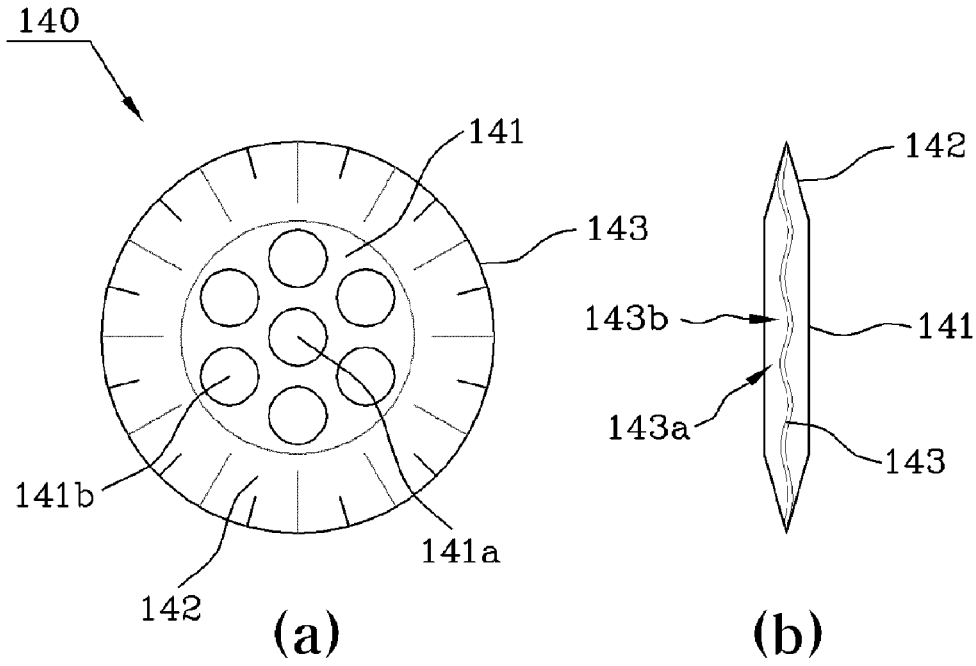
FIGS. 5A and 5B are a front view and a side view showing a rotary blade according to a second embodiment of the present invention.

FIGS. 5A and 5B are a front view and a side view showing a rotary blade according to a second embodiment of the present invention. This embodiment has the same construction as the first embodiment, except for a cutting blade part thereof, so a detailed description on the overlapping parts will be omitted.

The cutting blade part 143 of this embodiment is composed of convex portions 143*a* and concave portions 143*b* that alternately repeat in a circumferential direction. That is, the cutting blade part 143 has an waved shape. Then, the rotary blade 140 can penetrate into the penetrating part of a target more efficiently.

Figure 6:
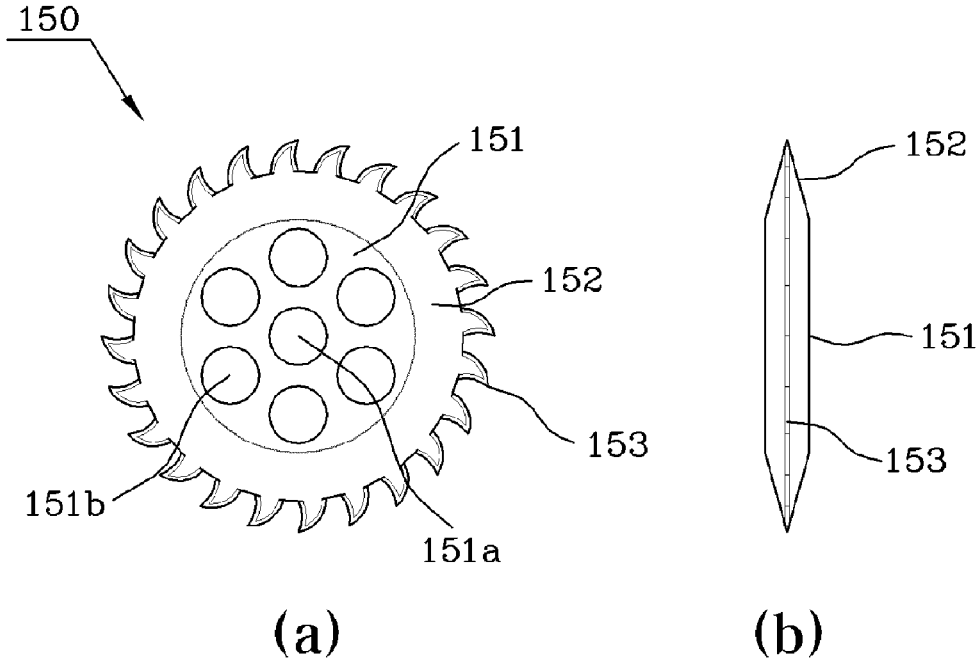
FIGS. 6A and 6B are a front view and a side view showing a rotary blade according to a third embodiment of the present invention.
Figure 7:
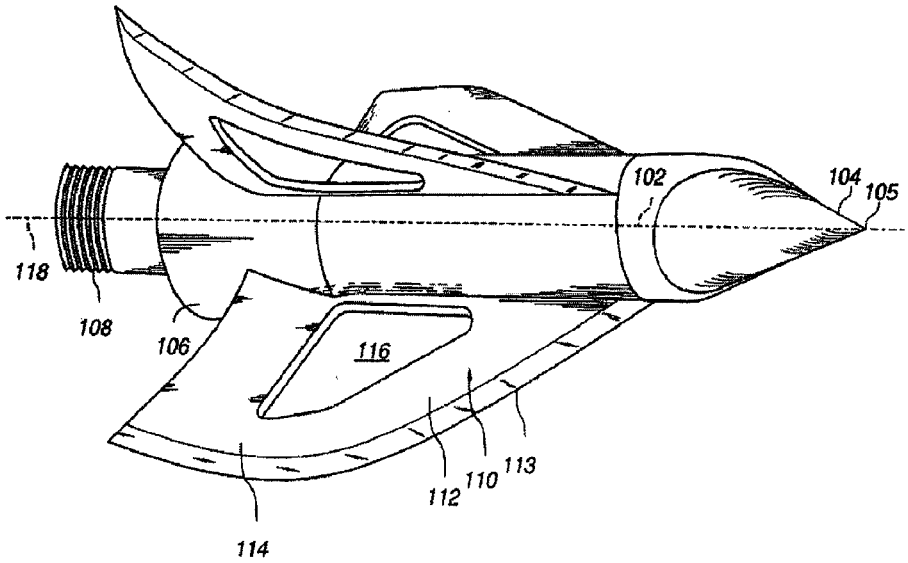
FIG. 7 PRIOR ART
FIG. 7 is a perspective view showing an example of a conventional broad type arrowhead.
Figure 8:
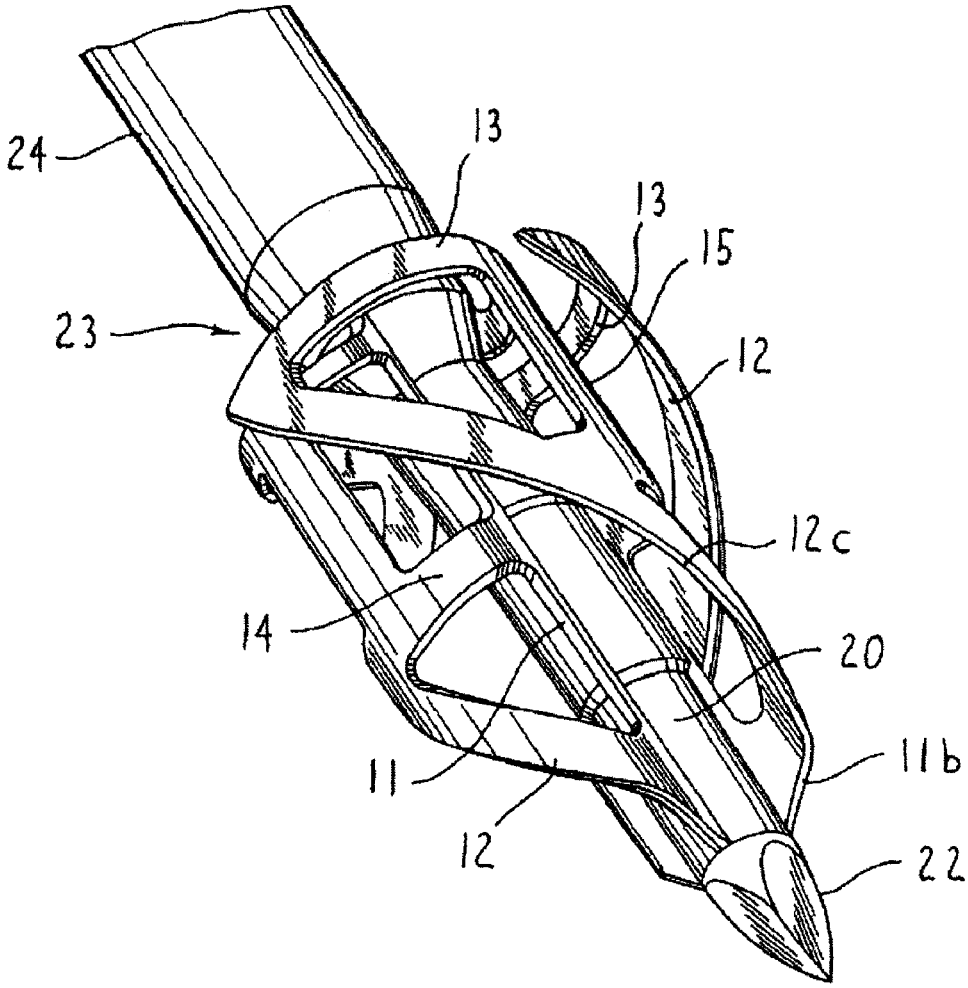
FIG. 8 PRIOR ART
FIG. 8 is a perspective view showing another example of a conventional broad type arrowhead.
Figure 9:
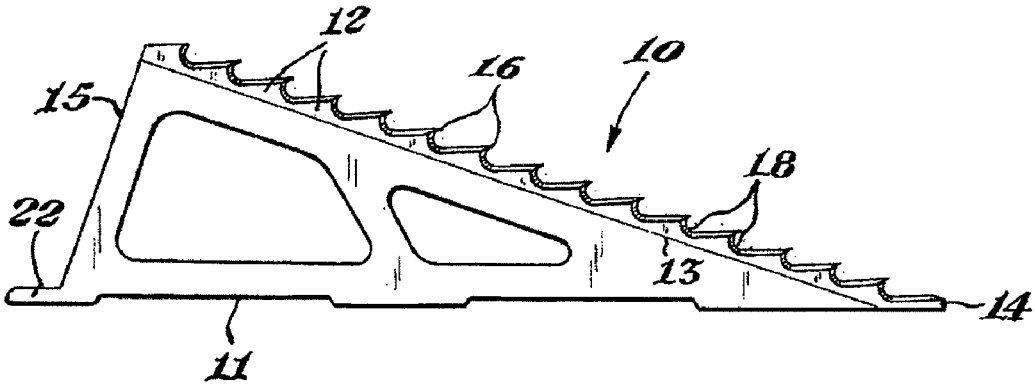
FIG. 9 PRIOR ART
FIG. 9 is a side view showing a further example of a conventional broad type arrowhead.
Figure 10:
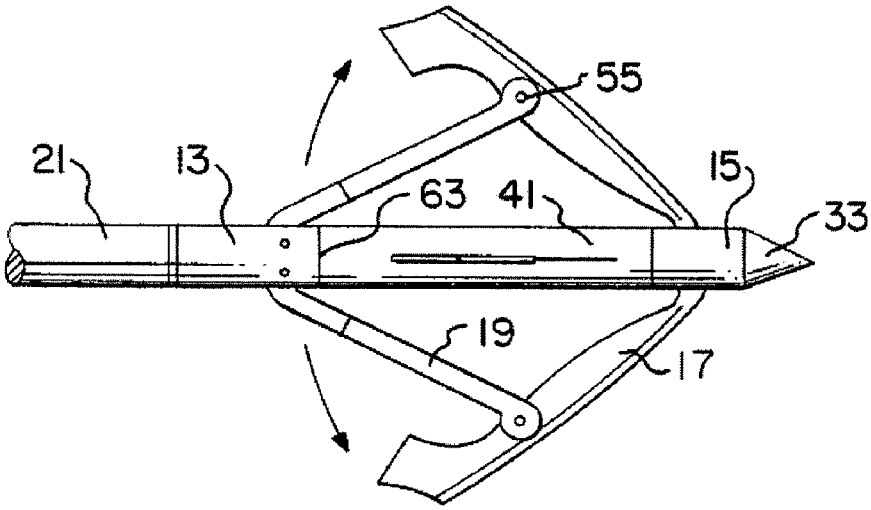
FIG. 10 PRIOR ART
FIG. 10 is a front view showing a further example of a conventional elastic arrowhead.

FIGS. 6A and 6B are a front view and a side view showing a rotary blade according to a third embodiment of the present invention. This embodiment has the same construction as the above-mentioned embodiments, except for a cutting blade part thereof, so a detailed description on the overlapping parts will be omitted.

The cutting blade part 153 of this embodiment is composed of a plurality of teeth that is continuously formed in a circumferential direction. Thus, the cutting blade part 153 has the sharpened teeth structure so that it can cut the target's skin and internal organs more efficiently.

The present arrowhead 100 having the above-mentioned configuration is additionally provided with the pair of rotary blades 130, in addition to the blade assembly 120 with the leading edges 121 formed, so that upon hitting game, it can form a deeper and wider wound, and even when it meets a skeleton such as bone or the like while it passes through the target's body, it can penetrate into the target's body while making a detour around the bone owing to the rotary blades 130.

The rotary blade 130, 140, and 150 is provided with a plurality of through-holes 131*b*, 141*b*, and 151*b*, in addition to the pin-holes 131*a*, 141*a*, and 151*a*.

That is, the present arrowhead can strike a fatal blow against a target and thus induce a deep and wide wound with profuse bleeding, exhibiting excellent lethality. Thus, a user does not need to chase game after an arrow stroke, and also the game does not suffer prolonged pain.

Particularly, the present arrowhead 100 can be easily adapted to a conventional planar type dual- or tri-blade assembly, and unlike the conventional spiral or elastic blade, there is no need for a complicated manufacturing process, so the present invention is simple to produce.

Further, unlike the conventional broad type arrowhead, the present arrowhead does not affect the flight stability of an arrow. That is, since the present arrowhead 100 is provided with the pair of circular rotary blades 130 together with the existing arrowhead structure, the phenomenon that occurs due to the spiral or elastic arrowhead so that the function of feathering is influenced so that an arrow jolts in flight and strikes a target with vertical and lateral deviations from a correct hit point is prevented.

While the description has been made of the preferred embodiments of the present invention, the technical scope of the present invention should not be limited thereto. That is, if in the case of rotary blade 130, while the above-mentioned embodiments have described so that the pair of the rotary blades are provided on opposite sides of the ferrule body 111, if needed, a single rotary blade 130 may be provided. For example, a mounting slot for a rotary blade may be formed at the central portion of the ferrule body 111, and then the single rotary blade 130 may be rotatably mounted in the mounting slot, or otherwise a single mounting slot for a rotary blade may be formed in the flat surface of the blade assembly 120, which is provided at the front portion of the ferrule body 111, instead of the through-hole 124, and then a single rotary blade may be rotatably mounted in the mounting slot.

The number of the rotary blades may vary according to the shape of the blade assembly 120 or the ferrule body 111, if needed.

Therefore, the technical scope of the present invention is not limited to the examples as described before, and the structure of the present rotary blade can be adapted to an arrowhead with a variety of shapes while employing the gist of the present invention.

As set forth above, the present hunting arrowhead can improve its penetration performance and lethality with respect to game without sacrificing flight stability and hit rate, compared to the conventional arrowhead. Further, the present arrowhead has a simple structure and thus improved productivity, relative to the conventional arrowhead. Thus, when adapting to a hunting arrow, the arrowhead exhibits excellent performance.

Although the embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A hunting arrowhead comprising:

a ferrule having a ferrule body, in which a fitting slot is formed in a longitudinal direction, and a mounting screw section extending rearwards from the ferrule body;

a blade assembly, a rear portion of which is fitted into the fitting slot, and in which a leading edge is formed on a side end thereof, and a mounting slot for a rotary blade and a rotary pin-receiving hole are formed in a flat surface thereof; and a rotary blade rotatably mounted in the mounting slot and having a pin-hole in a center thereof and a cutting blade part on a circumference thereof.

2. The hunting arrowhead according to claim 1, wherein the rotary blade includes a central flat portion with the pin-hole formed therein, an inclined portion extending in an inclined form towards an outer circumference from the central flat portion, and the cutting blade part formed on a circumference of the inclined portion.

3. The hunting arrowhead according to claim 2, wherein the rotary blade is provided with a plurality of through-holes passing through a surface thereof.

4. The hunting arrowhead according to claim 1, wherein the mounting slots and the rotary blades mounted thereto are provided in a pair on opposite sides of the ferrule body.

5. The hunting arrowhead according to claim 4, wherein the rotary blade includes a central flat portion with the pin-hole formed therein, an inclined portion extending in an inclined form towards an outer circumference from the central flat portion, and the cutting blade part formed on a circumference of the inclined portion.

6. The hunting arrowhead according to claim 5, wherein the rotary blade is provided with a plurality of through-holes passing through a surface thereof.

7. The hunting arrowhead according to claim 1, wherein the cutting blade part of the rotary blade is formed as an waved part including convex portions and concave portions that alternately repeat in a circumferential direction.

8. The hunting arrowhead according to claim 7, wherein the rotary blade includes a central flat portion with the pin-hole formed therein, an inclined portion extending in an inclined form towards an outer circumference from the central flat portion, and the cutting blade part formed on a circumference of the inclined portion.

9. The hunting arrowhead according to claim 8, wherein the rotary blade is provided with a plurality of through-holes passing through a surface thereof.

10. The hunting arrowhead according to claim 1, wherein the cutting blade part of the rotary blade includes a plurality of teeth that is continuously formed in a circumferential direction.

11. The hunting arrowhead according to claim 10, wherein the rotary blade includes a central flat portion with the pin-hole formed therein, an inclined portion extending in an inclined form towards an outer circumference from the central flat portion, and the cutting blade part formed on a circumference of the inclined portion.

12. The hunting arrowhead according to claim 11, wherein the rotary blade is provided with a plurality of through-holes passing through a surface thereof.

* * * * *

UNITED STATES PATENT AND TRADEMARK OFFICE

CERTIFICATE OF CORRECTION

PATENT NO. : 8,113,973 B1
APPLICATION NO. : 13/039958
DATED : February 14, 2012
INVENTOR(S) : Young Ki Lee It is certified that error appears in the above-identified patent and that said Letters Patent is hereby corrected as shown below:

ON THE TITLE PAGE:

Correct the Foreign Application Priority Data, at item (30), to read as follows:

-- Dec. 8, 2010 (KR) ..... 10-2010-0124911--.

Signed and Sealed this
Twenty-fourth Day of April, 2012

David J. Kappos

David J. Kappos
*Director of the United States Patent and Trademark Office*